US008814163B2

(12) United States Patent
Yamagata

(10) Patent No.: US 8,814,163 B2
(45) Date of Patent: Aug. 26, 2014

(54) PAPER FEEDER

(75) Inventor: Akihiro Yamagata, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 13/432,114

(22) Filed: Mar. 28, 2012

(65) Prior Publication Data

US 2012/0256365 A1 Oct. 11, 2012

(30) Foreign Application Priority Data

Apr. 5, 2011 (JP) ..... P2011-083728

(51) Int. Cl.
*B65H 5/34* (2006.01)
*B65H 9/14* (2006.01)

(52) U.S. Cl.
CPC .. *B65H 5/34* (2013.01); *B65H 9/14* (2013.01); *B65H 2513/10* (2013.01)
USPC ..... 271/270; 271/265.01

(58) Field of Classification Search
USPC ..... 271/270, 265.01
See application file for complete search history.

(56) References Cited

U.S. PATENT DOCUMENTS 5,104,110 A * 4/1992 Haibara ..... 271/9.02
5,461,468 A * 10/1995 Dempsey et al. ..... 399/396
7,380,789 B2 * 6/2008 Murrell et al. ..... 271/270
7,384,042 B2 * 6/2008 Sakakibara et al. ..... 271/270
7,549,626 B2 * 6/2009 Cook et al. ..... 271/10.02
8,006,976 B2 * 8/2011 Suzuki et al. ..... 271/270
8,047,528 B2 * 11/2011 Yasui et al. ..... 271/10.01
8,172,218 B2 * 5/2012 Suzuki et al. ..... 271/10.01
2009/0039588 A1 * 2/2009 Suzuki et al. ..... 271/10.03
2009/0166964 A1 * 7/2009 Fukasawa ..... 271/265.01

FOREIGN PATENT DOCUMENTS

JP 2009-40568 A 2/2009

* cited by examiner

*Primary Examiner* — Patrick Cicchino
(74) *Attorney, Agent, or Firm* — Nath, Goldberg & Meyer; Jerald L. Meyer

(57) ABSTRACT

A paper feeder includes a resist roller configured to convey a sheet to an image formation unit, a paper feed roller configured to convey a sheet to the resist roller, and a controller configured to control the paper feed roller such that the paper feed roller first conveys a sheet at a first conveying speed and then conveys the sheet while decelerating from the first conveying speed to a second conveying speed slower than the first conveying speed. The controller sets the first and second conveying speeds in advance to speeds which allow the paper feed roller to convey a single sheet by a predetermined conveying amount in a predetermined driving time period. The controller determines a time point to start a deceleration from the first conveying speed to the second conveying speed to allow a sheet to hit the resist roller at the second conveying speed.

5 Claims, 8 Drawing Sheets

PAPER FEEDER

CROSS REFERENCE TO RELATED APPLICATION

This application is based upon and claims the benefit of priority from the prior Japanese Patent Application No. 2011-083728, filed on Apr. 5, 2011, the entire contents of which are incorporated herein by reference.

BACKGROUND OF THE INVENTION

1. Field of the Invention

The present invention relates to a paper feeder provided to an image forming apparatus.

2. Description of the Related Art

There are paper feeders which are provided to an image forming apparatus and configured to convey a sheet of paper (hereinafter referred to as sheet) taken out from a paper feed tray to an image formation unit by using resist rollers, the image formation unit including ink jet heads or the like.

In such a paper feeder, while being conveyed by paper feed rollers, a sheet hits the resist rollers and is held against the resist rollers temporarily. In this way, a warpage is formed on the sheet. This corrects oblique conveyance of the sheet. The paper feeder then drives the resist rollers at a predetermined time to send the sheet to the image formation unit.

The sheet causes a collision noise when hitting the resist rollers. The collision noise is loud especially in an image forming apparatus capable of a high throughput (the number of sheets printed per unit time) because sheets are conveyed at a high speed therein. Moreover, the damage on the sheet due to the collision is large as well.

To reduce the shock of the collision of the sheet with the resist rollers, it is possible to provide a shock absorbing material to the resist rollers, for example. It is also possible to provide a noise isolation cover to suppress the noise. However, adding these members causes increase in the size and cost of the apparatus.

In this respect, Japanese Unexamined Patent Application Publication No. 2009-40568 discloses a paper feeder in which: paper feed rollers convey a sheet at a first conveying speed; and the conveying speed of the paper feed rollers is decelerated to a second conveying speed, which is lower than the first conveying speed, when a detector provided between the paper feed rollers and resist rollers detects the leading end of the sheet. The second conveying speed is set based on the time point at which the detector detects the leading end of the sheet. By using this conveyance control, the paper feeder described in Japanese Unexamined Patent Application Publication No. 2009-40568 reduces the collision noise and also maintains the throughput.

SUMMARY OF THE INVENTION

However, in the paper feeder described in Japanese Unexamined Patent Application Publication No. 2009-40568, since the second conveying speed is set based on the time point at which the detector detects the leading end of the sheet, the second conveying speed can be still too high in some cases, depending upon the time at which the leading end of the sheet reaches the detector. This leads to a loud collision noise of the sheet with the resist rollers, failing to provide an enough noise reduction effect.

The present invention has an object to provide a paper feeder capable of reducing a noise while maintaining its throughput.

An aspect of the present invention is a paper feeder comprising: a resist roller configured to convey a sheet to an image formation unit; a paper feed roller configured to convey a sheet to the resist roller; and a controller configured to control the paper feed roller such that the paper feed roller first conveys a sheet at a first conveying speed and then conveys the sheet while decelerating from the first conveying speed to a second conveying speed slower than the first conveying speed, the controller being configured to set the first and second conveying speeds in advance to speeds which allow the paper feed roller to convey a single sheet by a predetermined conveying amount in a predetermined driving time period, the controller being configured to determine a time point to start a deceleration from the first conveying speed to the second conveying speed to allow a sheet to hit the resist roller at the second conveying speed.

According to the aspect described above, the controller sets the first and second conveying speeds in advance which allow the paper feed roller to convey a single sheet by a predetermined conveying amount in a predetermined driving time period. Then, the controller controls the paper feed roller in such a way that it first conveys the sheet at the first conveying speed and then conveys the sheet while decelerating from the first conveying speed to the slower second conveying speed. In this event, the controller determines the time point to start the deceleration from the first conveying speed to the second conveying speed such that the sheet can hit the resist roller at the second conveying speed. In this way, the paper feeder can make the sheet hit the resist roller at the previously set, second conveying speed to reduce the noise while maintaining the throughput.

The paper feeder may further comprise a detection unit disposed between the paper feed roller and the resist roller and configured to detect a sheet. The controller may determine the time point to start the deceleration on a basis of a time point at which the detection unit detects a leading end of a sheet conveyed at the first conveying speed.

According to the above configuration, the time point to start the deceleration from the first conveying speed to the second conveying speed is determined based on the time point at which the detection unit detects the leading end of the sheet. In this way, the paper feeder can hit the sheet against the resist roller at the second conveying speed to reduce the noise even if there are variations in the time at which the sheet reaches the detection unit.

The paper feeder may further comprise a conveying-amount acquisition unit configured to acquire information indicative of a conveying amount of a sheet conveyed by the paper feed roller. When the conveying amount of the sheet conveyed by the paper feed roller indicated by the information acquired by the conveying-amount acquisition unit reaches a predetermined value after the time point of the detection, the controller may start a deceleration of a conveying speed of the paper feed roller from the second conveying speed to stop the paper feed roller.

According to the configuration described above, when the conveying amount of the paper feed roller indicated by the information acquired by the conveying-amount acquisition unit reaches a predetermined value, the controller starts the deceleration of the conveying speed of the paper feed roller from the second conveying speed. In this way, the paper feeder can accurately stop the paper feed roller in accordance with the actual conveying amount.

DETAILED DESCRIPTION OF THE EMBODIMENT

Figure 1:
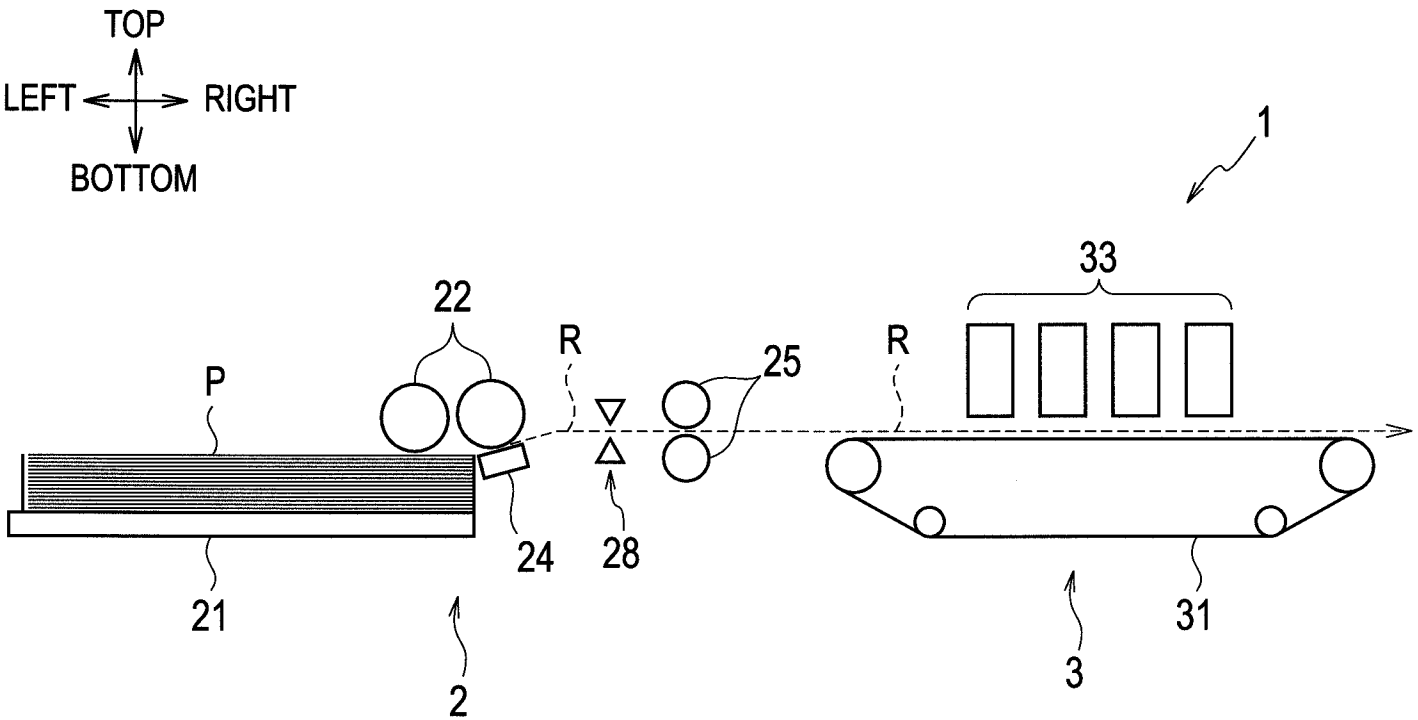
FIG. 1 is a schematic configuration diagram of an image forming apparatus including a paper feeder of an embodiment of the present invention.

Hereinbelow, an embodiment of the present invention will be described by referring to the drawings. Parts and components which are the same or similar from one drawing to another are denoted by the same or similar reference signs. It should be noted that the drawings are schematic and are different from the actual ones.

Figure 2:
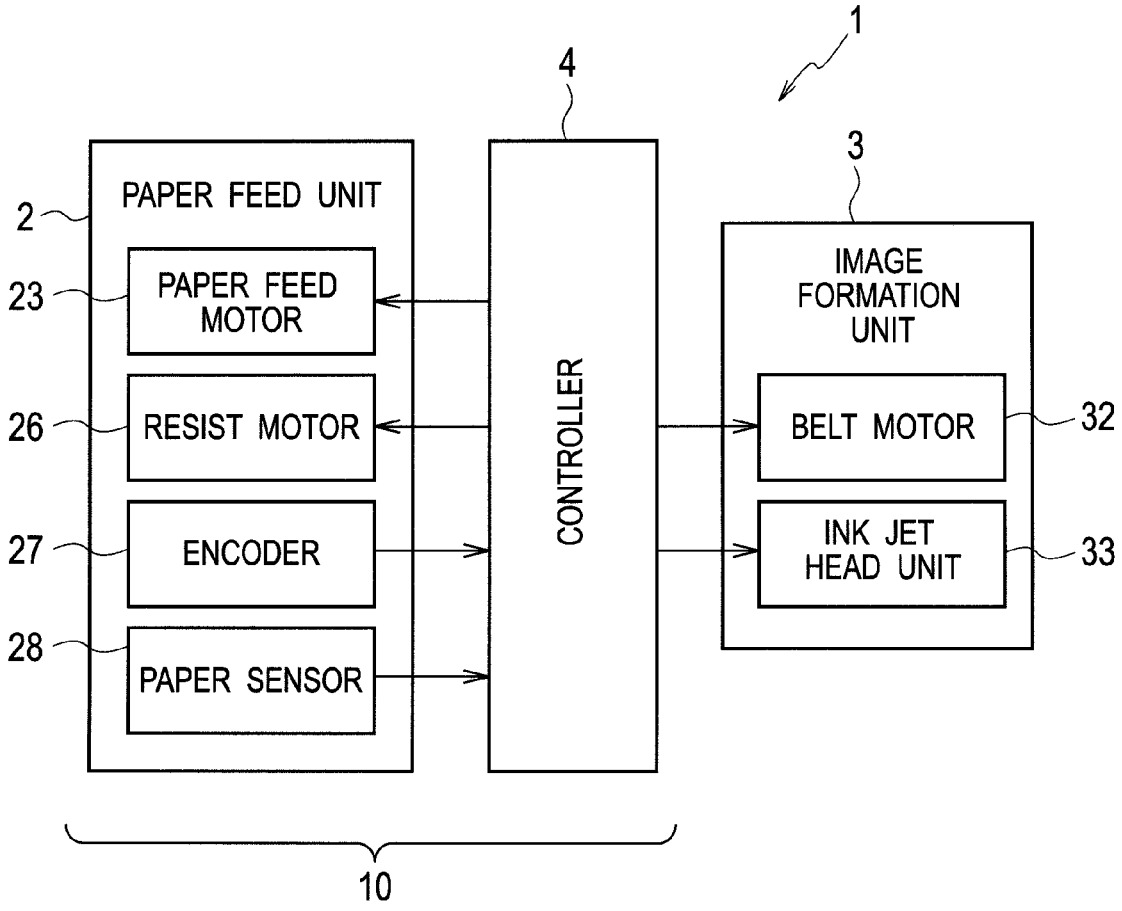
FIG. 2 is a block diagram showing the configuration of a control system of the image forming apparatus shown in FIG. 1.

FIG. 1 is a schematic configuration diagram of an imaging forming apparatus including a paper feeder 10 of the embodiment of the present invention. FIG. 2 is a block diagram showing the configuration of a control system of the image forming apparatus shown in FIG. 1. Top, bottom, left, and right in the following description refer to top, bottom, left, and right shown in FIG. 1, respectively. Moreover, the path shown by the broken line in FIG. 1 is a conveying path R through which sheets are conveyed, and a direction from left to right is the conveying direction. Upstream and downstream in the following description refer to upstream and downstream in the conveying path R, respectively.

As shown in FIGS. 1 and 2, an image forming apparatus 1 includes a paper feed unit 2, an image formation unit 3, and a controller 4. Note that the paper feeder 10 includes the paper feed unit 2 and the controller 4.

The paper feed unit 2 is configured to supply (feed) sheets to the image formation unit 3. The paper feed unit 2 is provided at the most upstream side of the conveying path R. The paper feed unit 2 includes a paper feed tray 21, paper feed rollers 22, a paper feed motor 23, a stripper plate 24, resist rollers 25, a resist motor 26, an encoder 27, and a paper sensor 28.

The paper feed tray 21 is where sheets P being image formation media are loaded.

The paper feed rollers 22 are configured to individually take out the sheets P loaded on the paper feed tray 21 and to convey it to the resist rollers 25. The paper feed rollers 22 are disposed above the paper feed tray 21. The paper feed rollers 22 have such a structure that they rotate by using the drive force of the paper feed motor 23 but, when the resist rollers 25 start to convey the sheet P, are rotated by movement of the sheet P.

The paper feed motor 23 is configured to rotationally drive the paper feed rollers 22.

The stripper plate 24 is configured to strip a sheet off other sheets so that the paper feed rollers 22 can convey the sheets one by one. The stripper plate 24 is in pressure contact with the downstream paper feed roller 22 from below.

The resist rollers 25 are configured to convey the sheet P, sent from the paper feed rollers 22, to the image formation unit 3 at a predetermined timing after the sheet P hits the resist rollers 25. The resist rollers 25 are disposed downstream of the paper feed rollers 22.

The resist motor 26 is configured to rotationally drive the resist rollers 25.

The encoder 27 is configured to detect the rotation angle of the rotary shaft of the paper feed motor 23 and generate a pulse signal corresponding to the rotation angle. This pulse signal is equivalent to information indicative of the conveying amount of the sheet P which the paper feed rollers 22 are conveying. The encoder 27 is equivalent to a conveying-amount acquisition unit.

The paper sensor 28 is disposed between the paper feed rollers 22 and the resist rollers 25 and is configured to detect the sheet P that is being conveyed on the conveying path R. The paper sensor 28 is formed of an optical sensor having a light emitting element and a light receiving element, for example. The paper sensor 28 is equivalent to a detection unit.

The image formation unit 3 is configured to form an image on the sheet P while conveying the sheet P. The image formation unit 3 includes a belt conveyer unit 31, a belt motor 32, and an ink jet head unit 33.

The belt conveyer unit 31 is configured to hold, on a looped conveyer belt, the sheet P fed from the paper feed unit 2 and to convey the sheet P by rotationally driving the conveyer belt. The belt conveyer unit 31 is disposed downstream of the resist rollers 25.

The belt motor 32 is configured to rotationally drive the conveyer belt that holds and conveys the sheet P in the belt conveyer unit 31.

The ink jet head unit 33 is disposed above the belt conveyer unit 31 and has multiple line-type ink jet heads each having multiple nozzles aligned in a direction perpendicular to the conveying direction of the sheet P. The ink jet head unit 33 is configured to jet inks from the ink jet heads to form an image on the sheet P conveyed by the belt conveyer unit 31.

The controller 4 is configured to control the operation of each unit in the image forming apparatus 1. The controller 4 is formed of a CPU, a RAM, a ROM, and the like.

To be specific, the controller 4 performs control that causes the paper feed unit 2 to feed the sheet P to the image formation unit 3, causes the belt conveyer unit 31 to convey the sheet P, and causes the ink jet head unit 33 to jet inks to print an image on the sheet P.

In the paper feed operation, the controller 4 drives the paper feed rollers 22 and the resist rollers 25 alternately for each individual sheet to be fed. Here, the controller 4 controls the paper feed rollers 22 in such a way that they first convey the sheet P at a conveying speed V1 (first conveying speed) and then convey the sheet P while decelerating from the conveying speed V1 to a slower conveying speed V2 (second conveying speed). In this event, the controller 4 determines the time point to start the deceleration from the conveying speed V1 to the conveying speed V2 such that the sheet can hit the resist rollers 25 at the conveying speed V2. The controller 4 sets up the conveying speeds V1 and V2 in advance as speeds with which the paper feed rollers 22 can convey a single sheet by a predetermined conveying amount La in a predetermined driving time period Ta. The driving time period Ta is determined as a time period allowed to drive the paper feed rollers 22 to achieve a desired throughput (the number of sheets printed per unit time) of the image forming apparatus 1. Moreover, the conveying amount La is a conveying amount necessary for the paper feed rollers 22 to hit the leading end of the sheet P against the resist rollers 25 and to form a warpage of a predetermined warping amount on the sheet P. Details of methods of determining the conveying speeds V1 and V2 and the time point to start the deceleration will be described later.

Next, operations of the image forming apparatus 1 will be briefly described.

Figure 3:
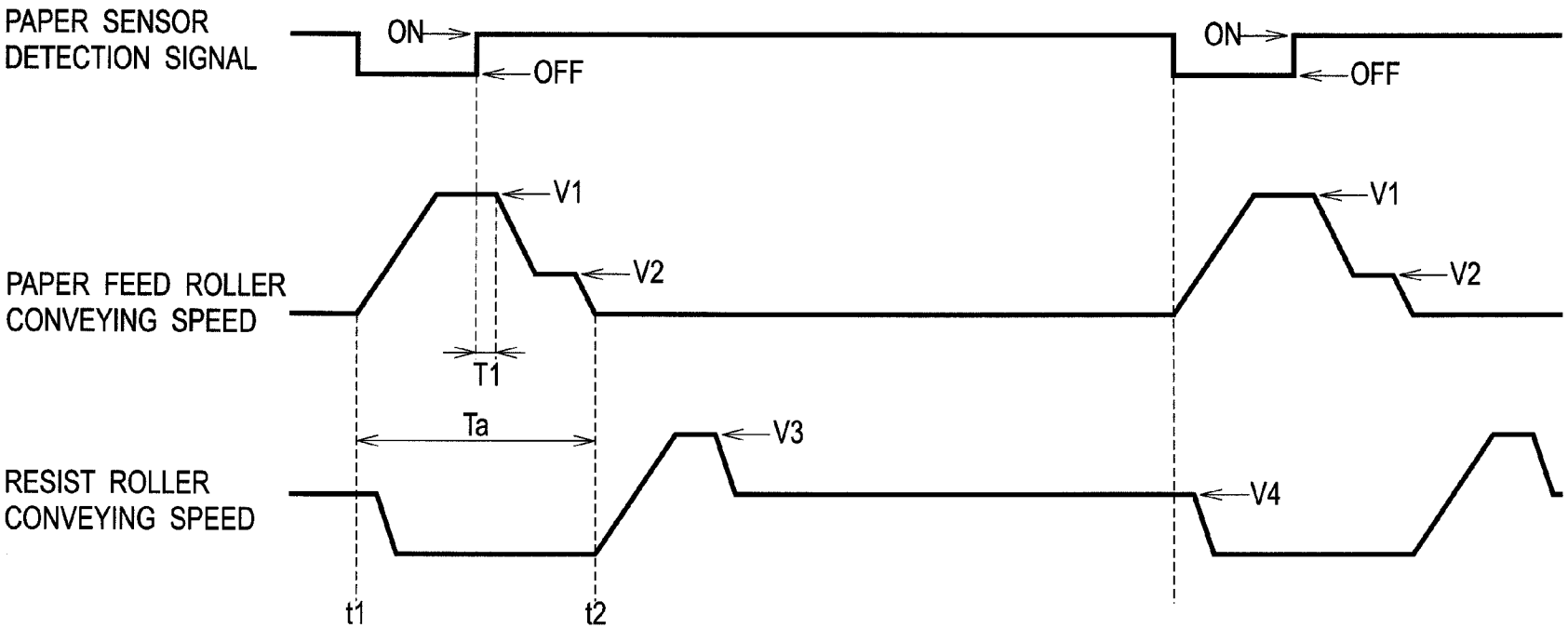
FIG. 3 is a timing chart showing changes in the detection signal of a paper sensor and in the conveying speeds of paper feed rollers and resist rollers.

FIG. 3 is a timing chart showing changes in the detection signal of the paper sensor 28 and in the conveying speeds of the paper feed rollers 22 and resist rollers 25.

The controller 4 activates the paper feed rollers 22 by using the paper feed motor 23 at a time t1 which is a timing to start driving the paper feed rollers 22. As a result, the paper feed rollers 22 start conveying the sheet P on the paper feed tray 21 to the downstream side.

During the image forming operation, the controller 4 rotationally drives the conveyer belt of the belt conveyer unit 31 by using the belt motor 32. The controller 4 drives the belt conveyer unit 31 such that the sheet P can be conveyed at a printing conveying speed Vg. The printing conveying speed Vg is related to the throughput and is set higher in a case of performing the printing at a higher speed for achieving a higher throughput.

After activating the paper feed rollers 22, the controller 4 accelerates the conveying speed of the paper feed rollers 22 at a predetermined acceleration αup. Once the conveying speed of the paper feed rollers 22 reaches V1, the controller 4 maintains the conveying speed V1.

When the paper sensor 28 detects the leading end of the sheet P conveyed at the conveying speed V1 (when the paper sensor 28 becomes ON), the controller 4 waits until a time period T1 elapses after the detection, and then starts deceleration of the conveying speed of the paper feed rollers 22 from V1 at a predetermined deceleration αdn. Once the conveying speed of the paper feed rollers 22 is decelerated to V2, the controller 4 maintains the conveying speed V2. The leading end of the sheet P will hit the resist rollers 25 at the conveying speed V2.

Thereafter, the controller 4 decelerates the conveying speed of the paper feed rollers 22 from V2 at the predetermined deceleration αdn to stop the paper feed rollers 22. The controller 4 performs control such that the paper feed rollers 22 can stop at a time t2 that is the driving time period Ta after the time t1 at which the paper feed rollers 22 are activated. At this point, a warpage is formed on the sheet P. As a result, oblique conveyance of the sheet P is corrected.

Then, at the time t2, the controller 4 activates the resist rollers 25 by using the resist motor 26. After activating the resist rollers 25, the controller 4 accelerates its conveying speed to V3. The controller 4 maintains the conveying speed of the resist rollers 25 at V3 for a predetermined time period and then starts decelerating it to a conveying speed V4. The conveying speed V4 is a speed substantially equal to the printing conveying speed Vg mentioned above. The controller 4 performs control such that the conveying speed of the resist rollers 25 can be decelerated to V4 before the leading end of the sheet P reaches the belt conveyer unit 31.

When the paper sensor 28 detects the trailing end of the sheet P (when the paper sensor 28 becomes OFF), the controller 4 activates the paper feed rollers 22 to feed the next sheet P. Once the sheet P leaves the resist rollers 25, the controller 4 stops the resist motor 26.

Next, the method of determining the conveying speed V1 will be described. The conveying speed V1 is determined due to such a need that the paper feed rollers 22 can make the leading end of the sheet P reach the resist rollers 25 and a warpage of a predetermined warping amount can be formed on the sheet P even under a condition where the conveyance ratio of the paper feed rollers 22 is the lowest.

Figure 4:
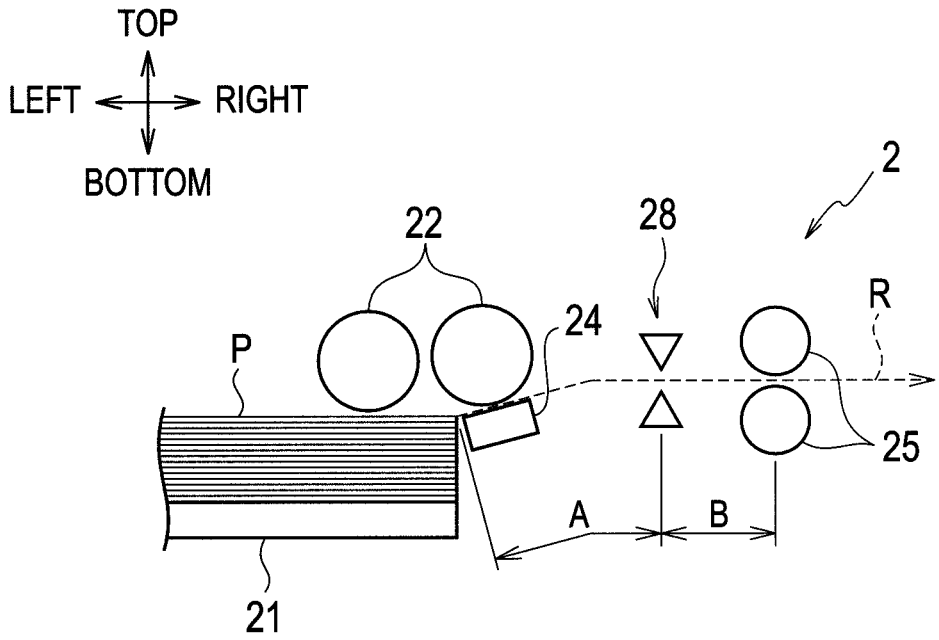
FIG. 4 is an enlarged diagram of a chief portion of the image forming apparatus shown in FIG. 1.

Here, as shown in FIG. 4, A is assumed as the distance from the position of the leading end (right end) of the sheet P loaded on the paper feed tray 21 to the detection position of the paper sensor 28, and B is assumed as the distance from the detection position of the paper sensor 28 to the resist rollers 25. The distances A and B are distances on the conveying path R.

Figure 5:
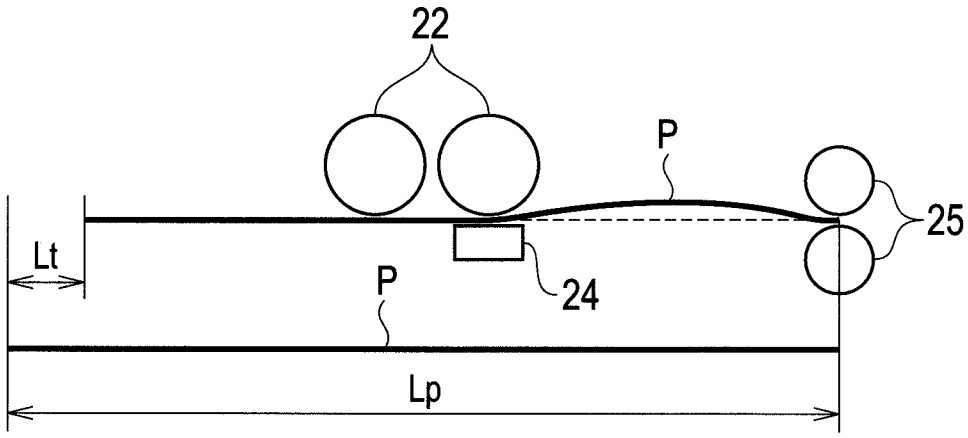
FIG. 5 is a diagram for describing a warping amount.

In addition, Lt is assumed as the predetermined warping amount. As shown in FIG. 5, the warping amount Lt is a length by which the sheet P becomes shorter than an original length Lp of the sheet P when the sheet P is hit against the resist rollers 25 and warped to an appropriate extent to correct oblique conveyance of the sheet P. Note that FIG. 5 shows the conveying path R as a straight path for the sake of simple explanation.

Moreover, the lowest value of the conveyance ratio is assumed as a lowest conveyance ratio β. The conveyance ratio is the ratio of the actual conveying amount of the paper feed rollers 22 to the logical value of the conveying amount thereof. The conveyance ratio varies depending upon the aging of the paper feed rollers 22, the dimensional accuracy, the type of sheet, the use environment, and so on. The lowest conveyance ratio β is figured out experimentally.

The aforementioned driving time period Ta is expressed by the following equation (1).

$$Ta=(A+B)Ng \tag{1}$$

As described, the driving time period Ta is determined based on the printing conveying speed Vg which is determined based on the throughput. As mentioned earlier, the printing conveying speed Vg is substantially equal to the conveying speed V4 of the resist rollers 25. The driving time period Ta shows a time period from when the trailing end of the sheet P not yet conveyed by the resist rollers 25 at the conveying speed V4 (=Vg) leaves the paper feed rollers 22 to when the trailing end leaves the resist rollers 25 and the resist rollers 25 stop. This is the time period allowed to drive the paper feed rollers 22.

Figure 6:
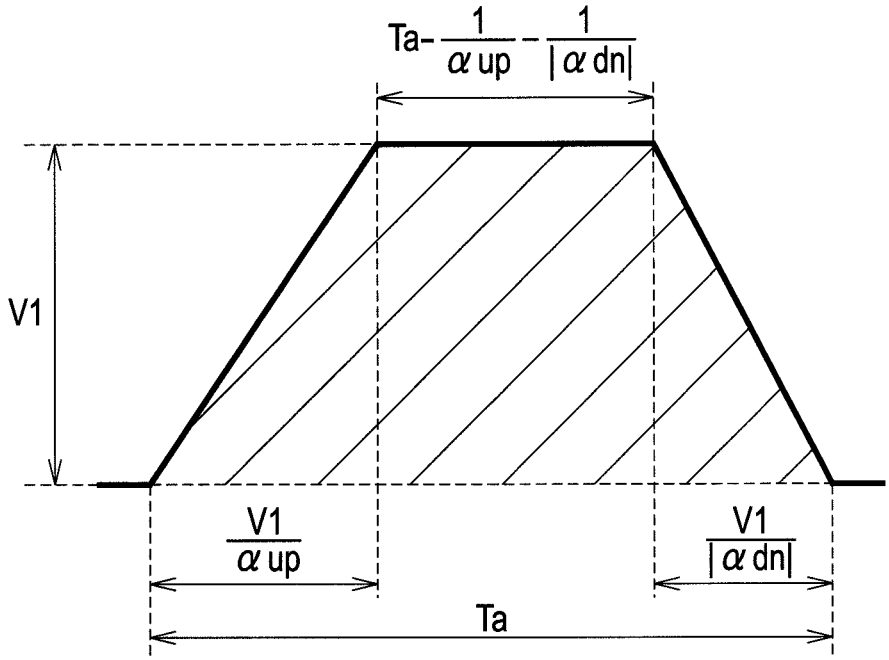
FIG. 6 is a diagram for describing a method of determining a conveying speed V1.

The conveying amount La mentioned earlier is expressed as La=A+B+Lt. In order for the paper feed rollers 22 to satisfy a condition that it has to convey the sheet P by the conveying amount La in the driving time period Ta even in a case of the lowest conveyance ratio β, the area of the shaded trapezoid shown in FIG. 6 should be La/β. That is, the following equation (2) should be satisfied.

$$La/\beta=V1^2(1/\alpha up+1/|\alpha dn|)/2+(Ta-V1/\alpha up-V1/|\alpha dn|)\times V1 \tag{2}$$

Here, the acceleration αup and the deceleration αdn are fixed values determined based on the specification of the paper feed motor 23.

Figure 7:
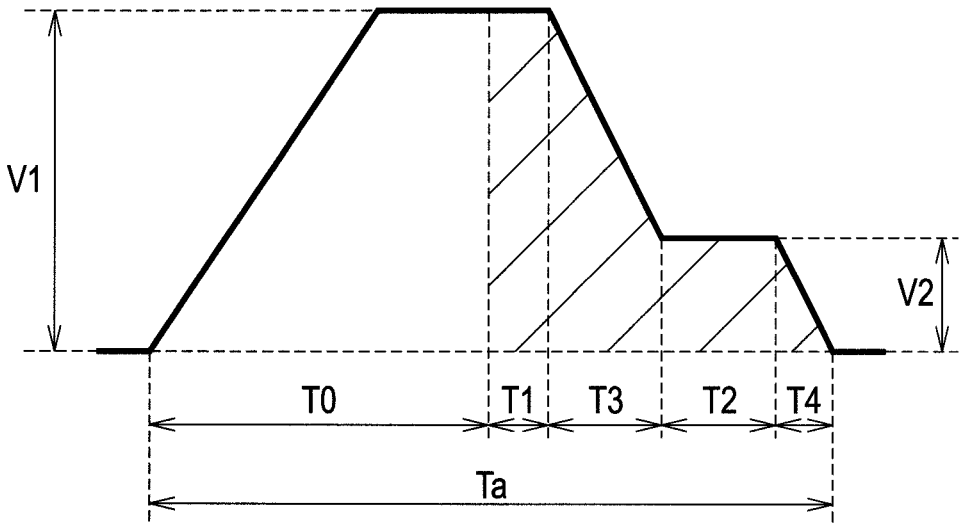
FIG. 7 is a diagram for describing a method of determining a conveying speed V2.

The conveying speed V1 can be figured out by solving the equation (2). Next, the method of determining the conveying speed V2 will be described. As shown in FIG. 7, TO is assumed as a time period from when the paper feed rollers 22 starts to be driven to when the paper sensor 28 detects the leading end of the sheet P. T1 is, as mentioned earlier, assumed as a time period from when the paper sensor 28 detects the leading end of the sheet P to when the conveying speed of the paper feed rollers 22 starts to be decelerated from V1. T2 is assumed as a time period from when the conveying speed of the paper feed rollers 22 reaches V2 to when the deceleration from V2 starts. T3 is assumed as a time period from when the conveying speed of the paper feed rollers 22 starts to be decelerated from V1 to when the conveying speed reaches V2. T4 is assumed as a time period from when the conveying speed of the paper feed rollers 22 starts to be decelerated from V2 to when the paper feed rollers 22 stop.

The necessary conveying amount of the paper feed rollers 22 after the detection of the leading end of the sheet P by the paper sensor 28 is B+Lt. For this reason, the area of the shaded region shown in FIG. 7 should be equal to B+Lt.

Here, the sum of the time period T3 and the time period T4 is a time period taken to decelerate the conveying speed of the paper feed rollers 22 at the deceleration αdn from V1 down to 0, and therefore T3+T4=V1/|αdn|. Then, the sum of the area of a shaded region corresponding to the time period T3 and the area of a shaded region corresponding to the time period T4 is (T3+T4)×V1×½=V1$^2$/2/|αdn|. Accordingly, that the area of the whole shaded region shown in FIG. 7 is equal to B+Lt can be expressed by the following equation (3).

$$V1\times T1+V2\times T2+V1^2/2/|\alpha dn|=B+Lt \quad (3)$$

Moreover, the relationship between the time periods in FIG. 7 satisfies the following equation (4).

$$T1+T2=Ta-T0-V1/|\alpha dn| \quad (4)$$

Figuring out T1 from the equations (3) and (4) leads to the following equation (5).

$$T1=\{B+Lt-V1^2/2/|\alpha dn|-V2\times(Ta-T0-V1/|\alpha dn|)\}/(V1-V2) \quad (5)$$

Figure 8:
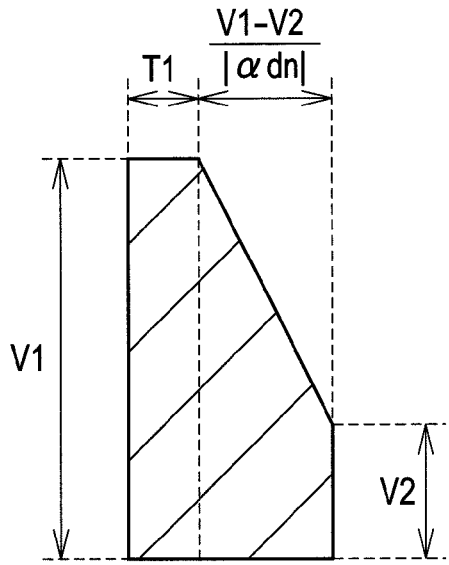
FIG. 8 is a diagram for describing the method of determining the conveying speed V2.

A conveying amount Lb of the paper feed rollers 22 during a time period from when the paper sensor 28 detects the leading end of the sheet P to when the conveying speed of the paper feed rollers 22 reaches V2 is expressed by the area of the pentagon shown in FIG. 8. Accordingly, Lb may be expressed by the following equation (6).

$$Lb=V1\times T1+(V1+V2)\times(V1-V2)/2/|\alpha dn| \quad (6)$$

In the equation (5), the distance B, the warping amount Lt, the deceleration αdn, and the driving time period Ta are fixed values or values that are determined based on the settings. The conveying speed V1 is a value determined based on the aforementioned equation (2). For this reason, by using a specific value for the time period T0, it is possible to calculate the value of the time period T1 relative to the value of the conveying speed V2 from the equation (5). Then, by using the calculated values of the conveying speed V2 and the time period T1, it is possible to calculate the value of the conveying amount Lb from the equation (6). That is, from the equations (5) and (6), the relationship between the conveying speed V2 and the conveying amount Lb can be figured out.

If the conveying amount Lb exceeds the distance B from the detection position of the paper sensor 28 to the resist rollers 25, the sheet P will hit the resist rollers 25 before the conveying speed of the paper feed rollers 22 is decelerated to V2. Thus, based on the relationship between the conveying speed V2 and the conveying amount Lb obtained from the equations (5) and (6), the conveying speed V2 is determined which has the minimum value within such a range that the conveying amount Lb would not exceed the distance B.

Figure 9:
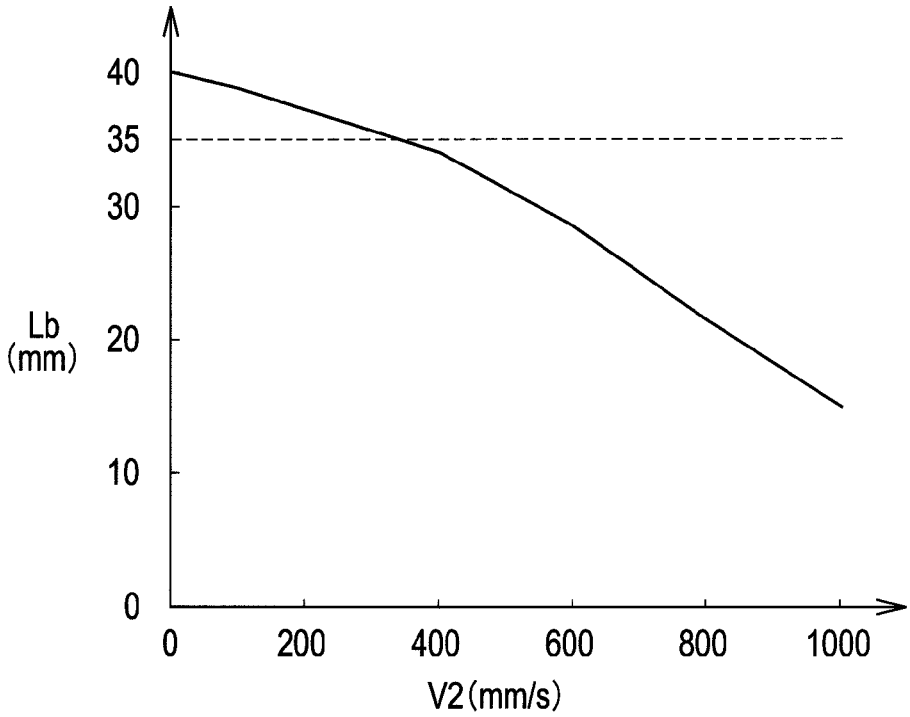
FIG. 9 is a diagram for describing the method of determining the conveying speed V1.

This will be described by using a specific example. Assume that A=63 mm, B=35 mm, Vg=632 mm/s, αup=40000 mm/s$^2$, αdn=−80000 mm/s$^2$, Lt=6 mm, and (3=0.7. In this case, Ta=0.115 s is obtained from the equation (1). Moreover, the conveying speed V1≈1850 mm/s is obtained from the equation (2). As for the time period T0, T0=0.07 s, which is obtained experimentally, is set as a value reflecting the longest delay in the arrival of the leading end of the sheet P at the paper sensor 28 in a case where the paper feed rollers 22 are driven in a setting having the above conveying speed V1. By using this value, the relationship between the conveying speed V2 and the conveying amount Lb is figured out from the equations (5) and (6). Then, the relationship appears as shown in FIG. 9. From FIG. 9, V2=400 mm/s, for example, may be determined as the value of the conveying speed V2 which is a low speed and with which the conveying amount Lb is less than B (=35 mm).

The conveying speeds V1 and V2 of the paper feed rollers 22 are determined as described above. The controller 4 sets these previously determined conveying speeds V1 and V2 as fixed values.

Figure 10:
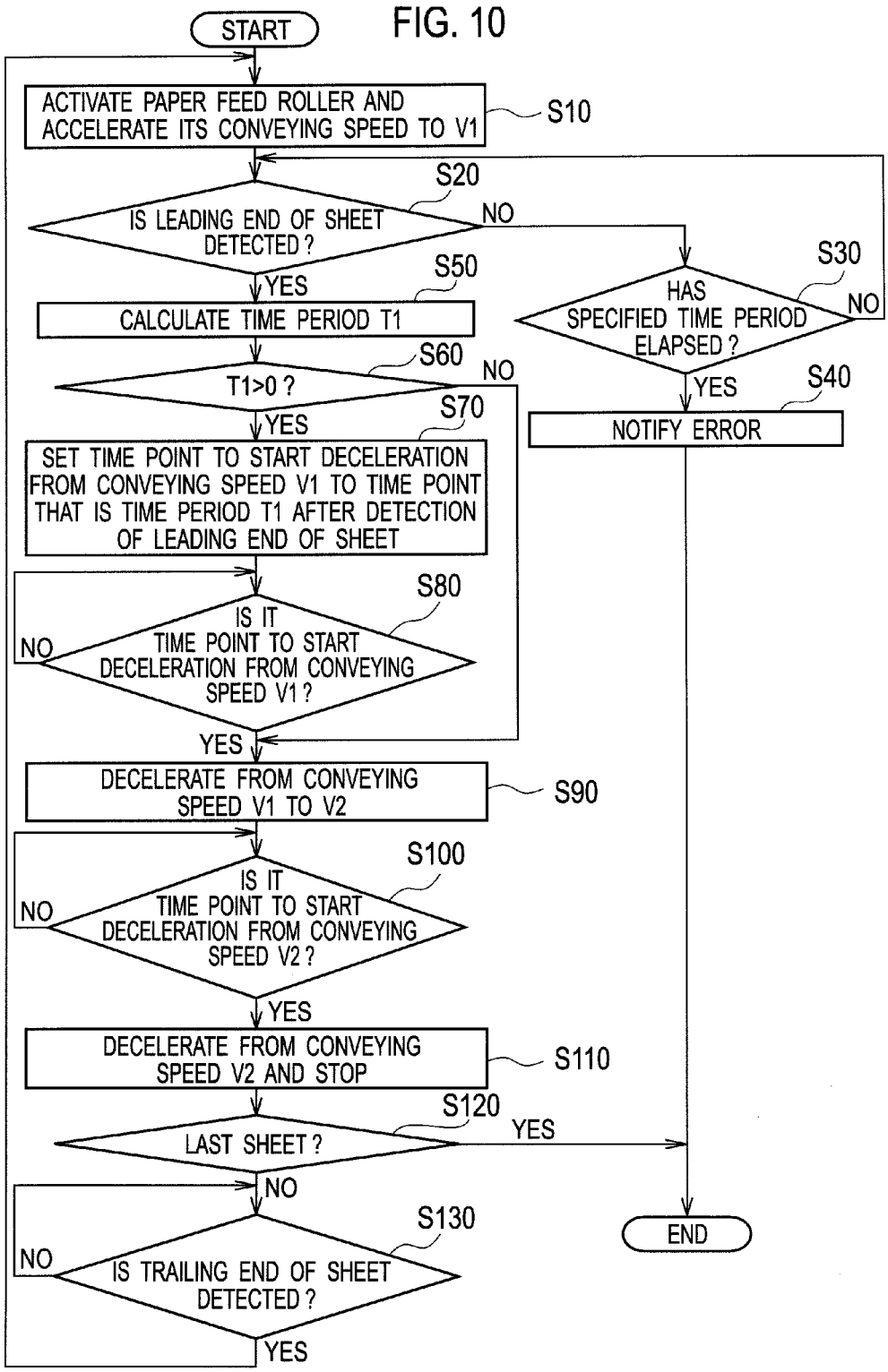
FIG. 10 is a flowchart for describing control on the paper feed controllers.

Next, control on the paper feed rollers will be described by referring to the flowchart in FIG. 10.

First, in step S10, the controller 4 activates the paper feed rollers 22 by using the paper feed motor 23 and accelerates the conveying speed thereof to V1 at the predetermined acceleration αup. As a result, the paper feed rollers 22 start conveying a sheet P on the paper feed tray 21 to the downstream side. Once the conveying speed of the paper feed rollers 22 reaches V1, the controller 4 maintains the conveying speed V1.

Next, in step S20, the controller 4 judges whether or not the leading end of the sheet P is detected by the paper sensor 28 (whether or not the paper sensor 28 has become ON).

If judging that the leading end of the sheet P is not yet detected (step S20: NO), then in step S30, the controller 4 judges whether or not a specified time period has elapsed since the activation of the paper feed rollers 22. The controller 4 returns to step S20 if judging that the specified time period has not yet elapsed (step S30: NO).

If judging that the specified time period has elapsed (step S30: YES), then in step S40, the controller 4 judges that jam (paper jam) has occurred, and notifies the user of the error by displaying error information on a display unit (unillustrated), for example. Then, the controller 4 terminates the control on the paper feed rollers 22.

If judging that the leading end of the sheet P is detected (step S20: YES), then in step S50, the controller 4 calculates the time period T1 on the basis of the time period T0 elapsed since the detection, i.e., since the start of the driving of the paper feed rollers 22. To be specific, the controller 4 calculates the time period T1 by inserting the value of the time period T0 into the aforementioned equation (5).

Subsequently, in step S60, the controller 4 judges whether or not T1>0. If judging that T1>0 (step S60: YES), then in step S70, the controller 4 sets the time point to start deceleration of the paper feed rollers 22 from the conveying speed V1, to a time point that is the time period T1 after the detection of the leading end of the sheet P by the paper sensor 28.

Subsequently, in step S80, the controller 4 judges whether or not it is the time point to start the deceleration of the paper feed rollers 22 from the conveying speed V1 which is set in step S70. The controller 4 iterates the process of step S80 if judging that it is not yet the time point to start the deceleration (step S80: NO).

If judging that it is the time point to start the deceleration (step S80: YES), then in step S90, the controller 4 starts the deceleration of the paper feed rollers 22 from V1 down to V2 at the deceleration αdn.

Meanwhile, if judging in steps S60 that T1≤0 (step S60: NO), then in step S90, the controller 4 starts the deceleration of the paper feed rollers 22 from the conveying speed V1 immediately after the detection of the leading end of the sheet P by the paper sensor 28. The controller 4 decelerates the paper feed rollers 22 at the deceleration αdn until the conveying speed thereof reaches V2.

After the conveying speed of the paper feed rollers 22 reaches V2, the leading end of the sheet P hits the resist rollers 25 at the conveying speed V2.

Subsequently, in step S100, the controller 4 judges whether or not it is the time point to start deceleration of the conveying speed of the paper feed rollers 22 from V2.

Here, as the time point to start the deceleration of the paper feed rollers 22 from the conveying speed V2, the controller 4 uses a time point at which the conveying amount of the paper feed rollers 22 after the detection of the leading end of the sheet P by the paper sensor 28 reaches a value (predetermined value) obtained by subtracting $V2^2/2/|\alpha dn|$ from B+Lt that is the necessary conveying amount after the detection. $V2^2/2/|\alpha dn|$ is a conveying amount by which the sheet P is conveyed after the start of the deceleration of the paper feed rollers 22 from the conveying speed V2 at the deceleration αdn.

To be specific, the controller 4 converts, into a conveying amount (distance), the number of output pulses of the encoder 27 since the detection of the leading end of the sheet P by the paper sensor 28. When this conveying amount reaches $B+Lt-V2^2/2/|\alpha dn|$, the controller 4 judges that it is now the time point to start the deceleration of the conveying speed of the paper feed rollers 22 from V2. The controller 4 iterates the process of step S100 if judging that it is not yet the time point to start the deceleration (step S100: NO).

If judging that it is the time point to start the deceleration (step S100: YES), then in step S110, the controller 4 starts the deceleration of the paper feed rollers 22 from V2 at the deceleration αdn until the paper feed rollers 22 stop.

Subsequently, in step S120, the controller 4 judges whether or not the sheet P which the paper feed rollers 22 have conveyed this time is the last sheet P among the specified number of sheets P. The controller 4 terminates the control on the paper feed rollers if judging that the sheet P is the last sheet P (step S120: YES).

If judging that the sheet P is not the last sheet P (step S120: NO), then in step S130, the controller 4 judges whether or not the trailing end of the sheet P is detected by the paper sensor 28 (whether or not the paper sensor 28 has become OFF).

The controller 4 iterates the process of step S130 if judging that the trailing end of the sheet P is not yet detected (step S130: NO). If judging that the trailing end of the sheet P is detected (step S130: YES), the controller 4 returns to step 10 to activate the paper feed rollers 22 to feed the next sheet P, and iterates the subsequent processes.

As described above, in the image forming apparatus 1, the controller 4 sets the conveying speeds V1 and V2 of the paper feed rollers 22 in advance as speeds which allow a single sheet to be conveyed by the predetermined conveying amount La in the predetermined driving time period Ta that is dependent on the throughput. Then, the controller 4 controls the paper feed rollers 22 in such a way that they first convey the sheet P at the conveying speed V1 and then convey the sheet P while decelerating from the conveying speed V1 to the slower conveying speed V2. In this event, the controller 4 determines the time point to start the deceleration from the conveying speed V1 to V2 such that the sheet P can hit the resist rollers 25 at the conveying speed V2. In this way, the image forming apparatus 1 can make the sheet P hit the resist rollers 25 at the previously set, slow conveying speed V2 to reduce the noise while maintaining the throughput.

Figure 11:
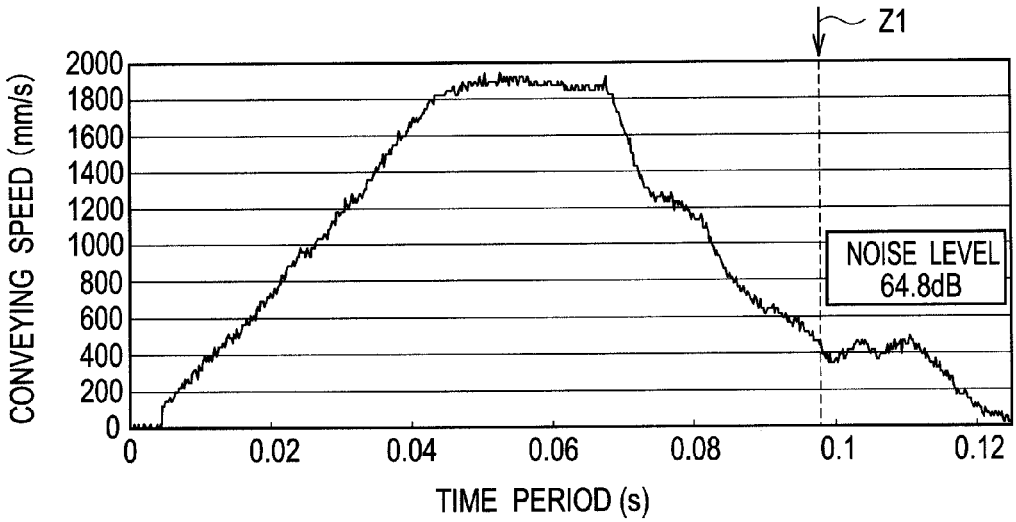
FIG. 11 is a diagram showing example measurement data of the conveying speed of the paper feed rollers in the image forming apparatus of the embodiment.
Figure 12:
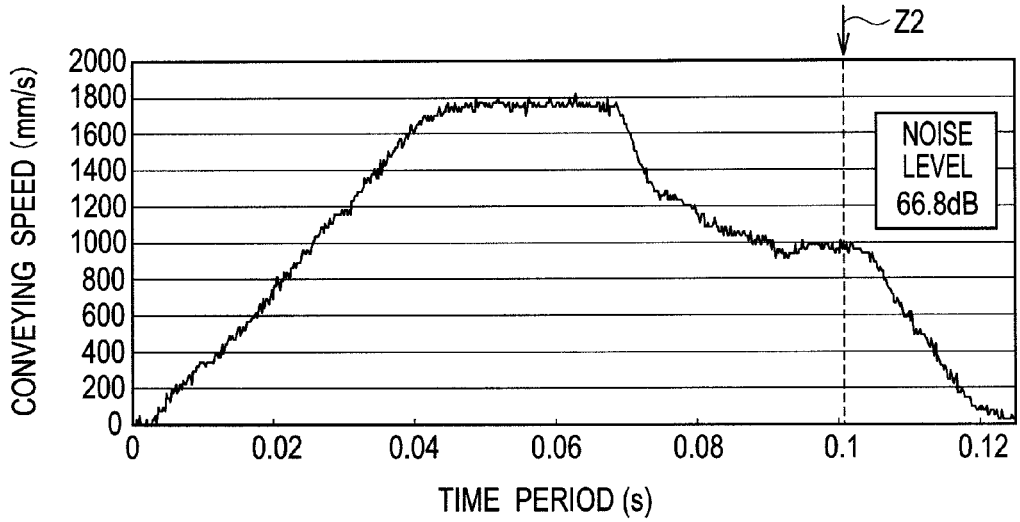
FIG. 12 RELATED ART
FIG. 12 is a diagram showing example measurement data of the conveying speed of the paper feed rollers that is based on a related drive control.

FIG. 11 is a diagram showing example measurement data of the conveying speed of the paper feed rollers 22 in the image forming apparatus 1 of this embodiment. On the other hand, FIG. 12 is a diagram showing example measurement data of the conveying speed of the paper feed rollers that is based on drive control of a related art. In FIG. 11, the arrow Z1 shows a time point at which the sheet P reaches the resist rollers 25. In FIG. 12, the arrow Z2 shows a time point at which the sheet reaches the resist rollers. In FIG. 11, the sheet P collides with the resist rollers 25 at a conveying speed of approximately 400 mm/s. The noise level at this time is 64.8 dB. In contrast, in FIG. 12, the sheet collides with the resist rollers at a conveying speed of approximately 1000 mm/s. The noise level at this time is 66.8 dB. As shown, this embodiment can reduce the noise.

Moreover, in the image forming apparatus 1, the time point to start the deceleration of the paper feed rollers 22 from the conveying speed V1 is determined based on the time period T1 which is calculated based on the time point at which the paper sensor 28 detects the leading end of the sheet P (i.e., the time period T0 since the start of the driving of the paper feed rollers 22). In this way, the image forming apparatus 1 can hit the sheet P against the resist rollers 25 at the conveying speed V2 to reduce the noise even if there are variations in the time at which the sheet P reaches the paper sensor 28.

Furthermore, in the image forming apparatus 1, the time point to start the deceleration of the paper feed rollers 22 from the conveying speed V2 is determined by using the conveying amount calculated from the number of output pulses of the encoder 27 since the detection of the leading end of the sheet P by the paper sensor 28. Once the time period T1 is calculated, it is possible to calculate the time period T2 from the equation (4). In the image forming apparatus 1, however, the time point to start the decoration is determined by using the actual conveying amount calculated from the number of output pulses of the encoder 27 as described above, instead of starting the deceleration at a time point that is the time period T2 after the conveying speed of the paper feed rollers 22 reaches V2. In this way, the image forming apparatus 1 can accurately stop the paper feed rollers 22 in accordance with the actual conveying amount, regardless of errors from the logical values of the operations of the paper feed motor 23 and paper feed rollers 22.

Note that although this embodiment has been described by taking an inkjet printer as the image forming apparatus 1, the present invention is not limited thereto.

A paper feeder according to the embodiment of the present invention has been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiment of the present invention are only a list of optimum effects achieved by the present invention. Hence, the effects of the present invention are not limited to those described in the embodiment of the present invention.

What is claimed is:

1. A paper feeder comprising:

a resist roller configured to convey a sheet to an image formation unit;

a paper feed roller configured to convey a sheet to the resist roller;

a detection unit disposed between the paper feed roller and the resist roller and configured to detect a sheet; and a controller configured to control the paper feed roller such that the paper feed roller first conveys a sheet at a first conveying speed and then conveys the sheet while decelerating from the first conveying speed to a second conveying speed slower than the first conveying speed, wherein the controller is configured to set the first and second conveying speeds in advance to speeds which allow the paper feed roller to convey a single sheet by a previously set conveying amount in a previously set driving time period that is determined based on a throughput, determine a time point to start a deceleration from the first conveying speed to the second conveying speed to allow a sheet to hit the resist roller at the second conveying speed while maintaining the throughput, determine the time point to start the deceleration on a basis of a time point at which the detection unit detects a leading end of a sheet conveyed at the first conveying speed, and start to activate the paper feed roller, accelerate a conveying speed of the paper feed roller to the first conveying speed, and maintain the first conveying speed, thereby conveying a sheet;

judge whether the leading end of the sheet being conveyed is detected by the detection unit;

upon judgment that the leading end of the sheet is detected, calculate a second time period on a basis of a first time period from a start of activating of the paper feed roller to a time point when the leading end of the sheet is detected by the detection unit;

judge whether the second time period is greater than 0;

upon judgment that the second time period as calculated is greater than 0, set the time point to start the deceleration to a time point that is the second time period as calculated after the time point when the leading end of the sheet is detected by the detection unit;

upon judgment that the second time period as calculated is not greater than 0, set the time point to start the deceleration to the time point when the leading end of the sheet is detected by the detection unit;

judge whether the time point to start the deceleration arrives; and upon judgment that the time point to start the deceleration arrives, start a deceleration of the paper feed roller from the first conveying speed and maintain the deceleration down to the second conveying speed.

2. The paper feeder according to claim 1, further comprising a conveying-amount acquisition unit configured to acquire information indicative of a conveying amount of a sheet conveyed by the paper feed roller, wherein when the conveying amount of the sheet conveyed by the paper feed roller indicated by the information acquired by the conveying-amount acquisition unit reaches a predetermined value after the time point of the detection, the controller starts a deceleration of a conveying speed of the paper feed roller from the second conveying speed to stop the paper feed roller.

3. The paper feeder according to claim 1, further comprising a stripper plate configured to strip sheets so that the paper feed roller conveys one sheet at a time to the resist roller.

4. The paper feeder according to claim 1, wherein the driving time period is previously determined based on a printing conveying speed which is determined based on the throughput.

5. The paper feeder according to claim 1, further comprising a paper feed tray on which a sheet is loaded, wherein the conveying amount is a sum of:

a distance from a position of the leading end of the sheet loaded on the paper feed tray to a detection position of the detection unit to the resist roller on the conveying path; and a warping amount of the sheet being hit against the resist roller and warped.

* * * * *